US006343430B1

(12) United States Patent
Martel

(10) Patent No.: US 6,343,430 B1
(45) Date of Patent: Feb. 5, 2002

(54) FIRING NIPPLE FOR MUZZLE LOADING FIREARM

(76) Inventor: Michel Martel, 111 St-Antoine sud, Lavaltrie, Quebec (CA), J0K 1H0

( * ) Notice: Subject to any disclaimer, the term of this patent is extended or adjusted under 35 U.S.C. 154(b) by 0 days.

(21) Appl. No.: 09/655,941

(22) Filed: Sep. 6, 2000

(30) Foreign Application Priority Data

Sep. 6, 1999 (GB) ..... 9920836

(51) Int. Cl.[7] ..... F41A 17/00
(52) U.S. Cl. ..... 42/83; 42/51
(58) Field of Search ..... 42/51, 83

(56) References Cited

U.S. PATENT DOCUMENTS 4,123,867 A * 11/1978 Peterson
4,135,321 A * 1/1979 Lewallyn
4,163,335 A * 8/1979 Ives
4,186,506 A * 2/1980 Pawlak et al.
4,516,157 A * 5/1985 Giangerelli
4,888,901 A * 12/1989 French et al.
5,016,379 A * 5/1991 Lambert
5,467,551 A * 11/1995 Kruse
5,632,109 A * 5/1997 Caudle
5,644,861 A * 7/1997 Knight
5,657,569 A * 8/1997 Jernigan et al.
5,907,920 A * 6/1999 Laney
6,226,916 B1 * 5/2001 Kendall

* cited by examiner

*Primary Examiner*—Charles T. Jordan
*Assistant Examiner*—Troy Chambers
(74) *Attorney, Agent, or Firm*—Eric Fincham

(57) ABSTRACT

A firing nipple for a muzzle loading firearm where there are provided a plurality of exterior wall sections of differing diameters to provide abutment shoulders to sealingly engage against surfaces on a breech plug, and an internal chamber having a tapering wall to direct the hot gasses. The arrangement substantially prevents blow back and provides for an increased efficiency in the firing of a weapon.

6 Claims, 3 Drawing Sheets

FIRING NIPPLE FOR MUZZLE LOADING FIREARM

FIELD OF THE INVENTION

The present invention relates to the general field of firearms and is particularly concerned with a firing nipple for muzzle loading firearm.

BACKGROUND OF THE INVENTION

Muzzle loading firearms which were once considered the ultimate weapon have been used increasingly in recent years both in tournaments and for hunting. Indeed, in some regions regulations allow for a extended hunting season for users of muzzle loading firearms since such their use allows the game to escape more easily.

Most muzzle loading firearms now use a so-called percussion type firing system instead of the so-called flintlock method which was prevalent up until the $19^{th}$ century. Conventional percussion type firing systems including a percussive firing cap and a nipple communicating with the firearm ignition chamber.

Conventional percussion caps are typically made out of a thin soft metal formed into a substantially cap shape. The percussion cap is provided with a relatively thin coating of priming compound on the inside of its flat surface of the closed portion of the cap. For the priming compound to ignite it must be compressed between two surfaces. During use, the percussion cap is placed on the nipple so that when the hammer strikes the cap the priming compound is compressed between the hammer and the nipple which thus acts as an anvil. Compression of the priming compound between the hammer and the nipple ignites the priming compound. This produces a predetermined quantity of burning gas in the nipple. The gas in the nipple is forced under considerable pressure into the ignition chamber of the firearm igniting the propellant charge therein. The firing cap naturally needs to fit snugly over the nipple in a position to be struck by the firearm's hammer.

The ignition assembly of most percussion type muzzle loading firearms further includes a breech plug mounted within the breech of the firearm. Typically the breech plug is screwed into the breech. The breech plug may be provided with a threaded nipple bore for threadably receiving the firing nipple.

Heretofore, nipples usable in conjunction with percussion caps to ignite the propellant charge in a firearm have included an elongated body having a passage extending longitudinally therethrough. Such passage generally includes a cylindrical primary chamber communicating with the cap receiving end of the nipple. This primary chamber serves as an explosion chamber for the percussion cap. The passage also includes a relatively small bore constriction chamber communicating with the gas discharge end of the nipple. This constriction chamber serves to restrict flow of particles out of the primary chamber whereby a high gas pressure within the primary chamber occurs at the time of the percussion explosion.

The prior art discloses various modifications of firing nipples. However, prior art constructions suffer from at least one major drawback. Indeed, misfiring of muzzle loading firearms utilizing a percussion cap and a percussion nipple has proven to be a common problem. The chance of misfiring would be lessened considerably by using a more powerful percussion or potent percussion cap. However, the use of a more powerful percussion cap would increase the risk of so-called blow back of the discharge from the percussion cap. Blow back occurs when the heated gases from the detonated firing cap blow back in the direction of the cap. It can be easily understood that such blow back adversely affect ignition efficiency and may even potentially present a danger to the firearm user. Such blow back effect may also occur from heated gases upon ignition of the propellant charge within the firearm ignition chamber, again diminishing the firearm performance and creating potential danger to the firearm user.

In order to reduce the amount of misfiring, improved firing caps have been developed. For example, the so-called 209 type of fire cap has proven to be more reliable.

Accordingly, there exists a need for an improved firing nipple for muzzle loading firearms.

SUMMARY OF THE INVENTION

According to one aspect of the present invention, there is provided a firing nipple for a muzzle loading firearm comprising a body portion having an inlet end and an outlet end, an exterior wall comprised of a first exterior wall section, a second exterior wall section and a third exterior wall section, the first exterior wall section being situated proximate the inlet end, the third exterior wall section being situated proximate the outlet end and the second exterior wall section being situated intermediate the first and third exterior wall sections, the first exterior wall section having a greater diameter than a diameter of the second exterior wall section to thereby form a first exterior abutment shoulder therebetween, the second exterior wall section diameter being greater than a diameter of the third exterior wall section to thereby form a second exterior abutment shoulder therebetween, an interior wall comprised of a first interior wall section, a second interior wall section and a third interior wall section, the first interior wall section being situated proximate the inlet end and defining a first chamber, the third interior wall section being situated proximate the outlet end and defining a third chamber, and the second interior wall section being located between the first interior wall section and the third interior wall section and defining a second chamber, the second interior wall section having an interior diameter less than a diameter of the first interior wall section to thereby form a first interior abutment shoulder therebetween, the second interior wall section interior diameter being less than a diameter of the third interior wall section, and an inwardly tapering wall section extending between the second interior wall section and the third interior wall section.

Advantages of the present invention include that the proposed firing nipple is specifically adapted to be used with relatively high performance percussion caps in muzzle loading firearms thus reducing the risks of misfiring.

The proposed firing nipple is specifically configured so as to provide easy and stable mounting of the percussion cap thereon. The firing nipple is provided with a built-in means for ensuring stable and safe support of the percussion cap.

The configuration of the passage formed in the firing nipple is optimized to increase the igniting capacity of the percussion cap. Furthermore, the firing nipple is provided with built-in means for reducing the risk of blow back both from the percussion cap and the propellant charge in the firearm.

DESCRIPTION OF THE PREFERRED EMBODIMENTS

Figure 6:
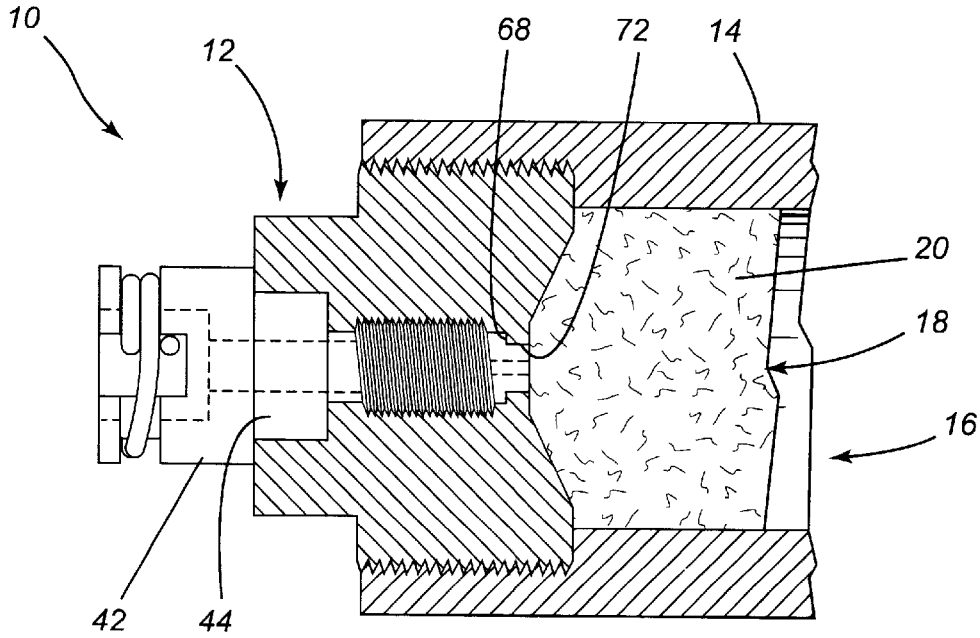
FIG. 6 is a partial longitudinal cross sectional view illustrating the firing nipple of FIG. 1 threadably mounted to a breech plug, the breech plug being screwed into the breech of a firearm.
Figure 7:
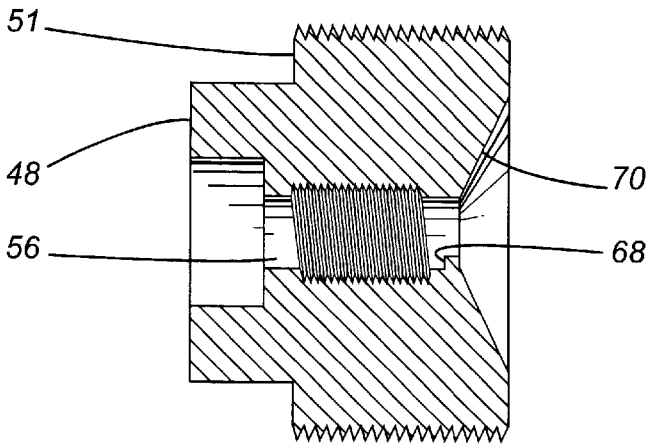
FIG. 7 is a partial longitudinal cross section of a conventional breech plug.

Referring initially to FIG. 6, there is shown a portion of a firearm employing a percussion cap firing system for igniting a propellant charge within the firearm. The percussion cap firing system includes a nipple 10 in accordance with one embodiment of the present invention and which is adapted to be threadably mounted to a breech plug 12. Breech plug 12 is, in turn, threadably mounted to the barrel 14 of a firearm. The barrel 14 is typically made out of a single piece of cast and machined steel defining a breech 16 therein. The rearward section of the breech 16 adjacent the breech plug 12 defines a powder chamber section 18 for receiving a propellant charge such as a gun powder 20 packed thereinto.

Referring now to FIGS. 1 to 5, there is shown in greater detail the configuration of the nipple 10. The nipple 10 has a generally elongated body defining a first or proximal end 22 and a longitudinally opposed second or distal end 24. The nipple 10 is provided with a longitudinal channel extending therethrough and which will be discussed in greater detail hereinbelow.

The external opposed longitudinal ends 22, 24 respectively have corresponding planer faces 26 and 28 which occupy substantially parallel geometrical planes. The nipple 10 defines a proximal annular rim section 30 intercepting the face 26. The annular rim section 30 is provided with two notches 32 formed radially therein. The notches 32 are configured and sized for receiving the blade of a conventional screwdriver or other tool adapted to facilitate rotation of the nipple 10 about its longitudinal axis.

The external configuration of the nipple 10 also defines an annular groove 34 positioned adjacent the annular rim section 30. The annular groove 34 is configured and sized for receiving a biasing means for concentrically biasing the body of the nipple 10 in the region of the groove 34 towards a smaller radius. In a preferred embodiment of the invention, the biasing means takes the form of a wire spring 36. Both the rim section 30 and the annular groove 34 are provided with a slot 38 intercepting at least a portion thereof. The slot 38 is adapted to slidably receive a locking end section 40 of the spring 36.

The external configuration of the nipple 10 further defines a first exterior wall section 42 and an adjacent second exterior wall section 44. The first exterior wall section 42 has an external diameter somewhat larger than that of the second exterior wall section 44 so that both the first and second exterior wall sections 42 and 44 define a first exterior abutment shoulder or surface 46 therebetween. As shown in FIG. 6, the first and second exterior wall sections 42 and 44 are configured and sized so that the first abutment shoulder 46 will matingly abut against an exterior shoulder or surface 48 of the breech plug 12.

The external configuration of the nipple 10 still further includes an exterior wall spacing section 50. The spacing section 50 has an external diameter somewhat smaller than that of the second exterior wall section 44 so that the spacing section 50 and the second exterior wall section 44 together define a second exterior abutment shoulder or surface 52 therebetween. The spacing section 50 and the second exterior wall section 44 are configured and sized so that the second abutment shoulder 52 matingly and sealingly abuts against a breech plug proximal internal shoulder 51. Also, the external diameter of the spacing section 50 is smaller preventing obstruction or interference.

The external configuration of the nipple 10 still further includes a mounting section 58 provided with an external thread 60. The external thread 60 is adapted to cooperate with the internal thread formed in the internal connecting channel 56 part of the breech plug 12. The mounting section 58 of the nipple 10 includes an outlet section 62 having an external diameter smaller than the threaded portion of the mounting section 58. The outlet section 62 and the rest of mounting section 58 thus define yet a third exterior abutment shoulder or surface 64 therebetween. The third exterior abutment shoulder 64 is configured and sized for matingly and sealingly abutting against a second internal shoulder 68 part of the breech plug 12. The length of the outlet section 62 is preferably sized so that the distal end 24 is positioned substantially adjacent a conically divergent wall 70 which forms part the breech plug 12. Typically, for Remington type and other firearms a spacing channel 72 extends between the internal threads 56 and the divergent wall 70 of breech plug 12. Outlet section 62 is thus adapted to extend at least partially through the internal spacing section 72 of the breech plug 12 for reasons which will be hereinafter disclosed.

In a preferred embodiment, the external diameter of the rim 30 and the first intermediate section 42 has a value substantially in the range of between 0.425" and 0.445", the external diameter of the second intermediate section 44 preferably has a value substantially in the range of between 0.32" and 0.34" and the external diameter of both spacing section 50 and outlet section 62 having a value substantially in the range of between 0.2" and 0.21". Typically, the nipple 10 has an overall length substantially in the range of between 0.875" and 0.975" with the length between the second abutment shoulder 52 and the second end 28 being substantially in the range of between 0.4" and 0.43". The length between the first and second abutment shoulders 46 and 52 is preferably substantially in the range of between 0.15" and 0.17" with a length between first end 26 and first abutment shoulder 46 being substantially in the range of between 0.33" and 0.37" while the annular groove 34 preferably has a thickness in the range of between 0.07" and 0.09".

Figure 1:
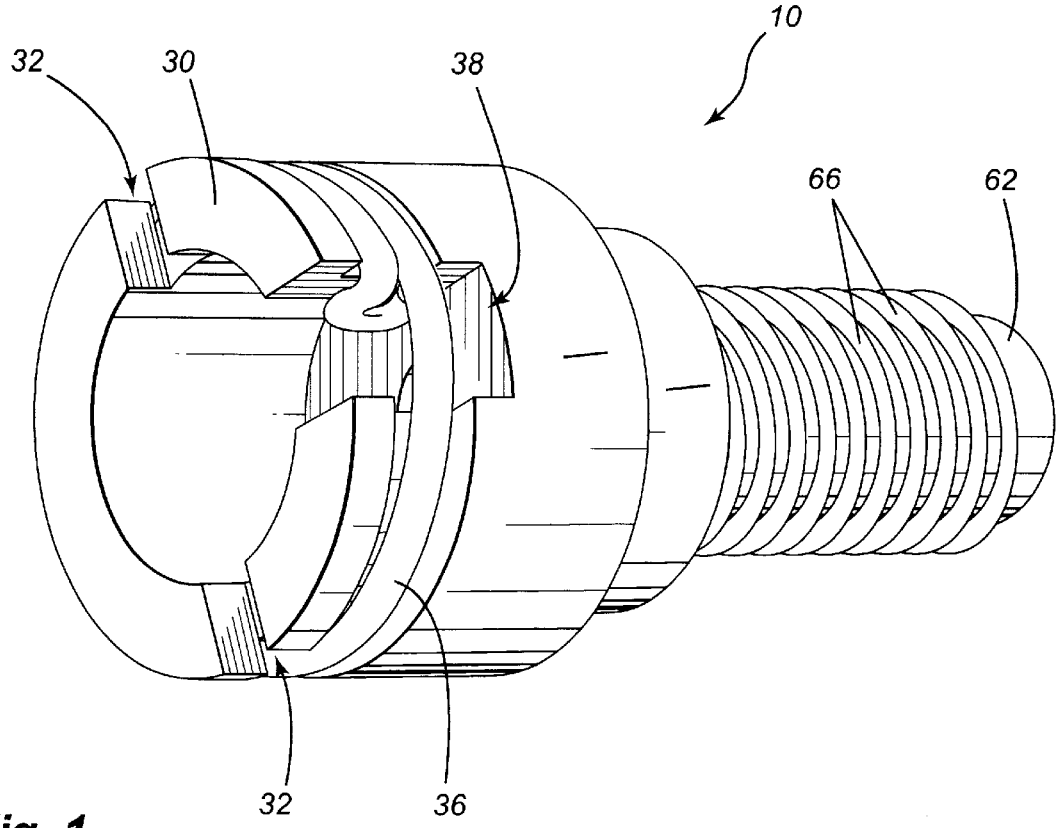
FIG. 1 is a perspective view illustrating a firing nipple for muzzle loading firearms in accordance with an embodiment of the present invention.
Figure 2:
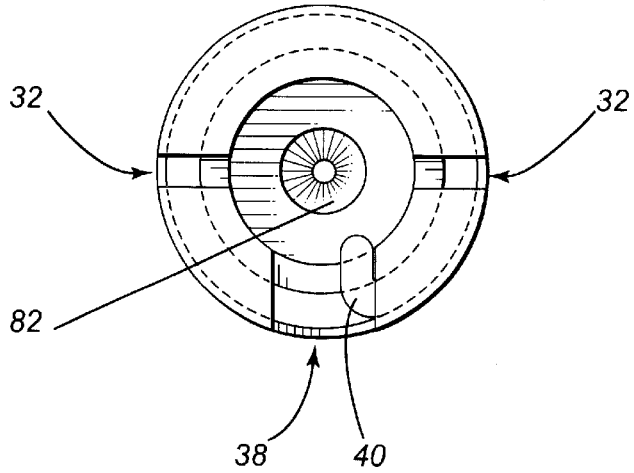
FIG. 2 is an end view of the firing nipple shown in FIG. 1 as seen from the left hand side thereof.
Figure 3:
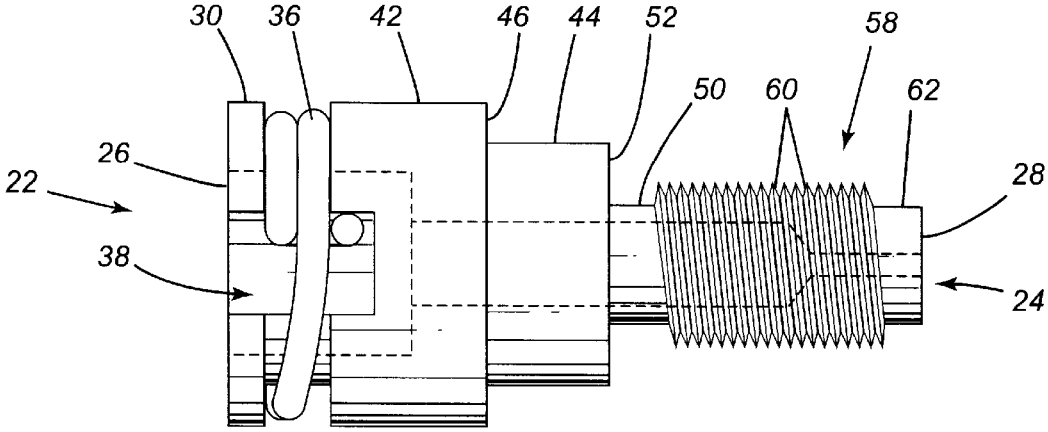
FIG. 3 is a top view of the firing nipple shown in FIG. 1.
Figure 4:
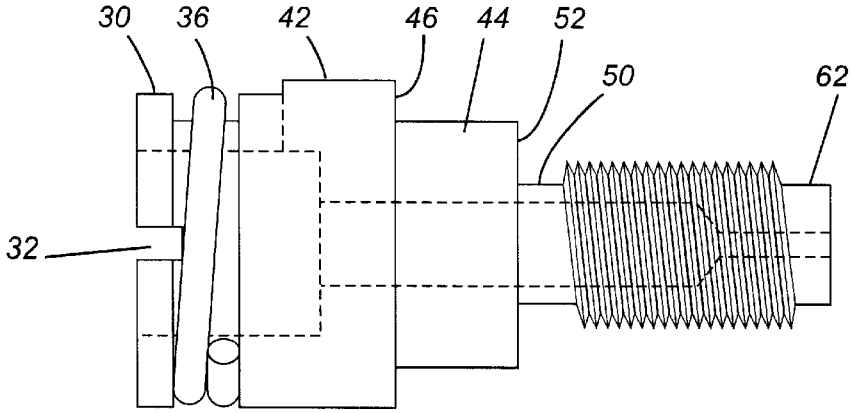
FIG. 4 is a side view of the firing nipple shown in FIG. 1.
Figure 5:
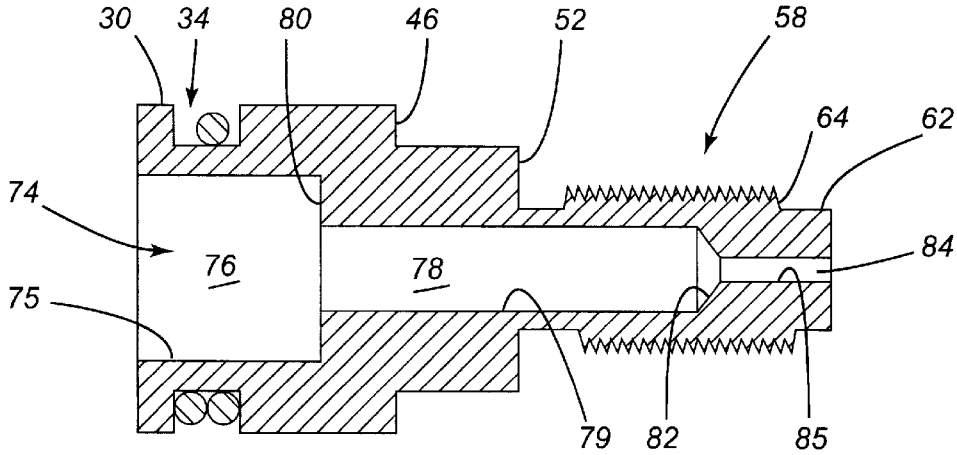
FIG. 5 is a longitudinal cross sectional view of the firing nipple shown in FIG. 1.

Turning now more specifically to FIG. 5, there is shown in greater detail the configuration of an internal longitudinal channel 74. Channel 74 includes a first large chamber section 76 defined by interior wall 75 and which is configured and sized for receiving an ignition cap. The first chamber section 76 extends into a second chamber 78 defined by interior wall section 79. An internal shoulder 80 is defined between the first chamber section 76 for abuttingly contacting the distal end of the cap. The second chamber 78 preferably has a generally cylindrical configuration that tapers conically at a distal end thereof into an intermediate section 82. The cone shaped intermediate section is defined by a conical wall disposed at an angle substantially in the range between 117° and 119° relative to the longitudinal axis of the nipple. The second chamber 78 extends integrally into a smaller diameter third chamber 84 defined by interior wall section 85. Joined passage sections 82 and 84 define a funnel shaped chamber.

In operation, the nipple 10 is threadably attached to the breech plug 12. The ready the firearm for firing, the propellant charge such a gunpowder 20 is packed into the powder chamber 18 and a percussion cap 78 is slidably introduced into the first chamber section 76. The cap is releasably attached to the nipple 10 using the spring type component 36 mounted in the annular slot 74 with the locking segment 40 extending through the slot 38.

The cap contains the usual internal explosive charge. A hammer type component, when released by a suitable trigger, strikes the cap exploding its charge. The exploding particles initially extend into the second chamber 78 and are momentarily contained therein under high pressure. The high pressure forces, the heated bases and particles through the tapered conical wall section 82, into the outlet chamber 84 and thence, into the firing chamber 18. The heated gases and particles then ignite the propellant charge in the firearm. The sudden rush of hot explosive gases rapidly flowing to or out of the ignition port provide a simultaneous expulsion of the bullet from the gun muzzle.

As mentioned previously, the proposed invention is adapted to reduce the risk of blow back. The gas blow back is at least partially related to the fact that at the instant of cap firing, heated gas particles fill the primary chamber creating an intense pressure therein for a brief period. If not quickly released into the main firing chamber the pressurized particles of gas will blow back against the cap. Secondly, following ignition of the firearm propellant charge, a portion of the gasses and particles form that charge are forced back inside the nipple creating further blow back. From the foregoing, it can be appreciated how the present invention in nipple design substantially reduces blow back. Firstly, the first chamber 76 is solidly created with minimal apertures extending threrethrough and is designed so as to reduce the formation of the cap upon ignition of the latter. The only aperture extending through the first chamber 76 retaining the cap consists of the slot 38 used for maintaining the cap within the chamber 76.

The design of the second chamber 78 is also adapted to extend the periods during which the cap combustion products are contained therein. This extended period of time allow more product of ignition to reach the propellant and allows them to achieve the transfer over an extended period of time. The ignition material is thus allowed to reach a higher ignition temperature within the chamber 78 which will, in turn, result in a higher reliability of ignition of the powder 20.

The angular relationship of the cone shaped wall 82 with the longitudinal axis of the nipple 10 allows for a better gas outlet which reduces the risks of blow back within the nipple. This risk is further reduced by the use of a single outlet.

The risk of blow back is still further reduced by the use of at least two and preferably three abutment shoulders 46, 52 and 64 which sealingly abut against corresponding surfaces of the breech plug 12 for preventing blow back towards the cap 78. In order to allow for unobstructed abutment of the shoulders 46, 52 and 64 against corresponding abutment surfaces of the breech plug 12, the spacing section 50 is undersized relative to the external diameter of the threaded channel 56 part of the breech plug 12. Also, the external thread 60 part of the mounting section 58 is given a thread step substantially in the range of 273 to 274 thousands of an inch in order to increase resistance to pressure forces created by the ignition.

Furthermore, the outlet section 62 allows the ignition gases to reach directly the divergent cone shaped wall 70 part of the breech plug 12. Typically, the divergent wall 70 has an angle substantially in the range of 100° relative to the longitudinal axis of the breech 12 plug which allows the ignition gases to reach a wider initial surface of powder 20. The powder 20 thus ignites more rapidly which, in turn, again reduces the risk of misfiring.

I claim:

1. A firing nipple for a muzzle loading firearm comprising:

a body portion having an inlet end and an outlet end;

an exterior wall comprised of a first exterior wall section, a second exterior wall section and a third exterior wall section;

said first exterior wall section being situated proximate said inlet end;

said third exterior wall section being situated proximate said outlet end and said second exterior wall section being situated intermediate said first and third exterior wall sections;

said first exterior wall section having a greater diameter than a diameter of said second exterior wall section to thereby form a first exterior abutment shoulder therebetween;

said second exterior wall section diameter being greater than a diameter of said third exterior wall section to thereby form a second exterior abutment shoulder therebetween;

an interior wall comprised of a first interior wall section, a second interior wall section and a third interior wall section;

said first interior wall section being situated proximate said inlet end and defining a first chamber;

said third interior wall section being situated proximate said outlet end and defining a third chamber, and said second interior wall section being located between said first interior wall section and said third interior wall section and defining a second chamber;

said second interior wall section having an interior diameter less than a diameter of said first interior wall section to thereby form a first interior abutment shoulder therebetween;

said second interior wall section interior diameter being less than a diameter of said third interior wall section; and an inwardly tapering wall section extending between said second interior wall section and said third interior wall section.

2. The firing nipple of claim 1 wherein said first exterior wall section includes an annular recess formed therein, and a wire spring member mounted in said annular recess.

3. The firing nipple of claim 1 wherein said first end includes a rim, a slot being formed in said rim and extending diametrically across said rim.

4. The firing nipple of claim 1 further including a spacing section exterior wall between said second exterior wall section and said third exterior wall section, said spacing section exterior wall having a diameter less than said third exterior wall section.

5. The firing nipple of claim 1 further including an outlet exterior wall section extending from said third exterior wall section, said outlet exterior wall section having a diameter less than said third exterior wall section diameter to thereby form a third exterior abutment shoulder therebetween.

6. The firing nipple of claim 2 wherein said interior tapering wall section forms an angle of between 117° and 119° with respect to a longitudinal axis of said body portion.

* * * * *